US005402678A

United States Patent [19]

Fritz et al.

[11] Patent Number: 5,402,678

[45] Date of Patent: Apr. 4, 1995

[54] DEVICE AND PROCESS FOR MONITORING THE NUMBER OF MOVEMENTS OF AT LEAST ONE MOVABLE PART OF A FIREARM

[75] Inventors: Raimund Fritz, Trossingen-Schura; Bernd Hartenstein, Oberndorf-Aistaig, both of Germany

[73] Assignee: Hechler, Koch GmbH, Oberndorf am Neckar, Germany

[21] Appl. No.: 13,727

[22] Filed: Feb. 4, 1993

[30] Foreign Application Priority Data

Feb. 7, 1992 [DE] Germany ..... 42 03 585.6

[51] Int. Cl.[6] ..... F41A 31/00

[52] U.S. Cl. ..... 73/167

[58] Field of Search ..... 73/167; 42/1.01; 346/38

[56] References Cited

U.S. PATENT DOCUMENTS

| | | | |
|---|---|---|---|
| 2,430,810 | 11/1947 | Fowler . | |
| 3,747,251 | 7/1973 | Baker | 42/1.01 X |
| 4,001,961 | 1/1977 | Johnson et al. . | |
| 4,541,191 | 9/1985 | Morris et al. | 42/1.01 |
| 4,913,655 | 4/1990 | Pinkley et al. . | |
| 5,005,307 | 4/1991 | Horne et al. | 42/1.02 |
| 5 033,217 | 7/1991 | Brennan | 42/1.01 |
| 5,052,138 | 10/1991 | Crain | 42/1.02 |

FOREIGN PATENT DOCUMENTS

| | | |
|---|---|---|
| 3716883 | 12/1988 | Germany . |
| 3911804 | 10/1990 | Germany . |
| 4022038 | 1/1992 | Germany . |

*Primary Examiner*—William A. Cuchlinski, Jr.
*Assistant Examiner*—Willie Morris Worth
*Attorney, Agent, or Firm*—R. Lewis Gable

[57] ABSTRACT

The invention relates to a device as well as a method of monitoring the movements of a breech-block of a firearm, in which the time duration of a sequence of cyclical movements of the breech-block is sensed to provide a like sequence of pulses. Each cyclical movement of the breech-block from and to a rest position provides a pulse of a width initiated upon the movement of the breech-block from the rest position and terminated upon the return movement of the breech-block to the rest position, each part movement corresponding to a bullet firing. The number, duration and time spacing between successive ones of the pulses is analysed to determine the nature of the firearm operation effected by at least one movement of the breech-block.

14 Claims, 3 Drawing Sheets

FIG. 2a
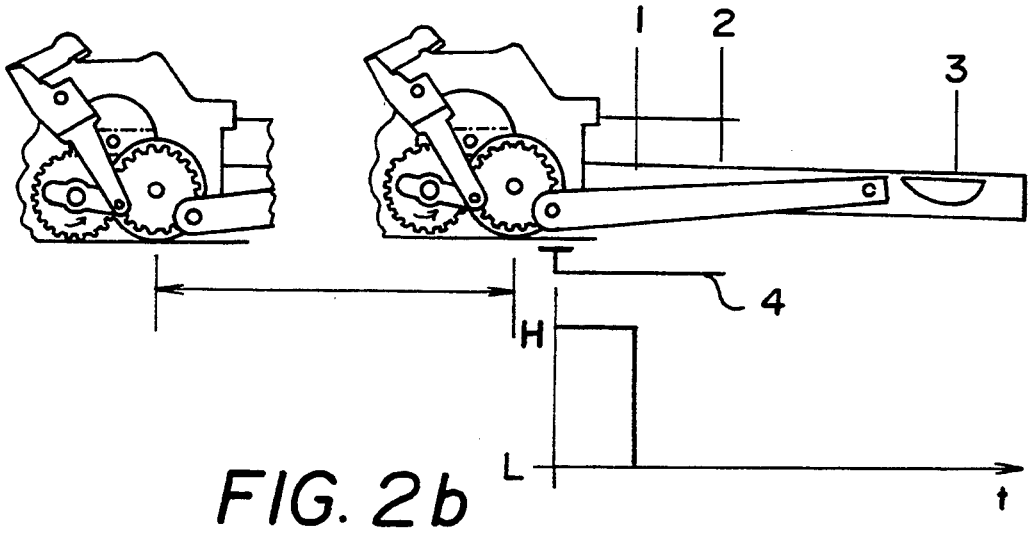
FIG. 2b
FIG. 3a
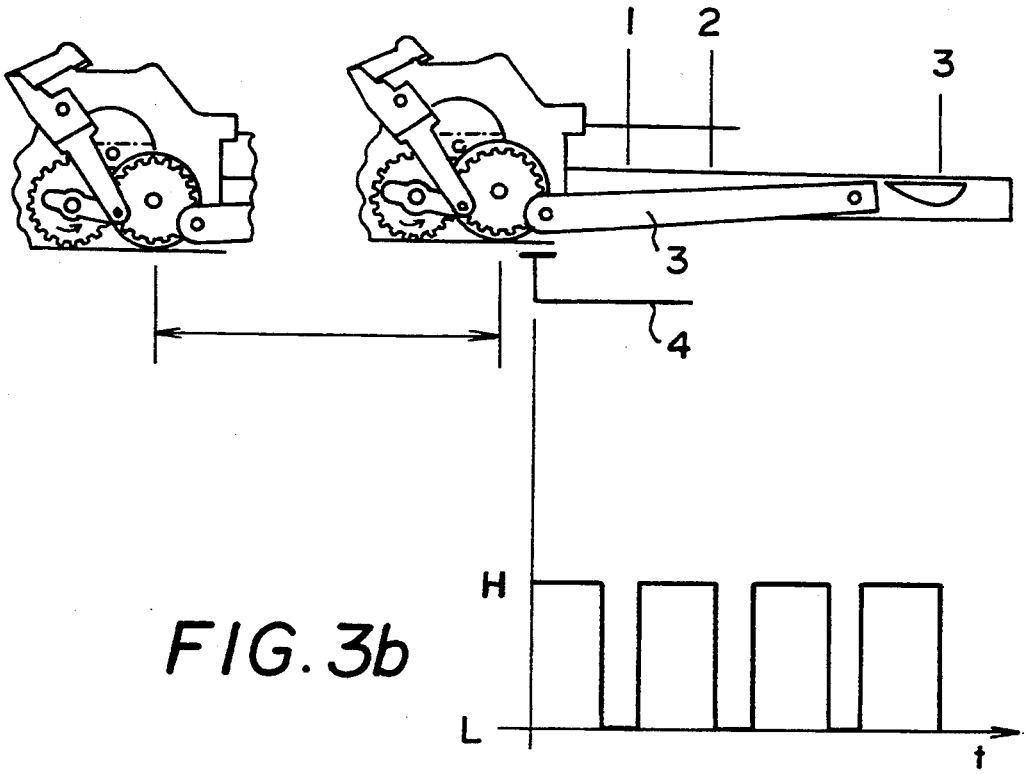
FIG. 3b

DEVICE AND PROCESS FOR MONITORING THE NUMBER OF MOVEMENTS OF AT LEAST ONE MOVABLE PART OF A FIREARM

FIELD OF THE INVENTION

The invention relates to a device and to a process for monitoring the number of movements of at least one movable part of a firearm.

BACKGROUND OF THE INVENTION

Monitoring devices of this type are used preferably in a hand firearm, especially in a rapid-fire rifle. In principle, however, they can be used also in other firearms, such as, for example, compressed-gas weapons, e.g., sport high-power air rifles, cannon, or also aircraft onboard guns and the like.

In military hand firearms, which as a rule are also arranged for the delivery of brief bursts and relatively long sustained firing, on components of the weapon in use there arise loads which lead to wear on these components. These loads, however, depending on the manner of use of the weapon, are extremely diverse. Thus, for example, in the case of a training operation during which the weapon is frequently loaded by hand but is seldom fired in single shots and still more rarely in burst firing or continuous firing, completely different loads arise than, for example, when the firearm is frequently fired with live ammunition. Also the stress on components in single firing, continuous firing or burst firing is different.

Accordingly, loading by hand, single-shot firing, burst firing or continuous firing impose different types of load and can lead to different manifestations of wear.

In order to avoid the necessity of changing the worn parts frequently or unnecessarily, there is known from German Patent DE-OS 37 16 883 a test apparatus for testing firearms for manifestations of wear. There, especially the state of the weapon and ammunition are to be rapidly determined and, if need be, continuously rechecked. In order to make this possible, optical measurement sensors are provided on the firearm, in which case a missile flying by or a shell case briefly alters the values ordinarily measured on the sensor. From these altered values a microcomputer measures the flight speed of the shell cases, compares that with a desired speed and thereby determines the measurement for the actual condition of the weapon and shell case. If the actual speed and desired speed fall too far apart, then by exchange of worn parts a reconditioning is performed.

Since, however, the weapon must be fired for the purpose of checking, this checking is complicated. Furthermore, it can be carried out only in a special refitting unit.

There is known, moreover, an operation indicator which has a monitoring device with an acceleration measuring sensor and a switching circuit which has on its part an electronic memory connected with the measuring sensor. This monitoring device remains permanently mounted on a firearm. On each shot, to be sure under some circumstances such as impact of the weapon against the ground, there occurs such a high acceleration of the measuring sensor that this it gives off a signal. These signals are summed up in the memory. In an inspection of the weapon this memory, which is provided with plug connections, must be connected to a control apparatus. On the control apparatus then there can be read the number of shots so far fired with the weapon, or, more exactly, the signals given off by the acceleration sensor.

Furthermore, the memory can receive parameters, such as, for example, codings, which, in turn, make possible an identification of the weapon. The codings can indicate the manufacture date of the weapon, the weapon number, the number of shots before placing in operation, the date of the last testing, the type of exchanged parts with date and respective number of shots as well as test data for firing pins, energy and trigger-pulling force. If a control apparatus is connected to the firearm, then these specific data are likewise readable from the memory.

The acceleration measuring sensor in this state of the art is adjusted so that it does not respond to loading by hand. This case of load, which arises primarily, for example, in a training unit or in a firearm used in guard duty, is not covered. The right point of time for the refitting of a firearm by changing a worn part cannot be determined dependably with the aid of this operation indicator.

The plug contacts of the monitoring apparatus in this known operation indicator have to be mounted covered because of the danger of corrosion. It is only in the inspection that they are laid open, which, however, is very bothersome. The danger of corrosion there is not entirely avoided. In this connection, it is warned that fouled contacts lead to incorrect measurements.

In German Patent DE-OS 39 11 804 for the recording of the firing impulse in a pistol or a rifle, a sensor is provided which is electrically connected with an IC element. This receiver can be constructed inter alia also as an impact or pressure sensor, which records the recoil and impulse occurring in the firing of the weapon and transmits a signal of corresponding value to the IC element. Here it is disadvantageous that the sensor is separated from the weapon to such an extent that an effect similar to a shot is registered on the sensor likewise, whether it be by impact, sound or pressure, but there the measured results are incorrect.

A similar, extended sensor construction is disclosed in German Patent De-OS 40 22 038. With the aid of three sensors, impulses are distinguished from one another according to acceleration and direction. Since in the case of German Patent DE-OS 40 22 038 it is a matter of a type of further development of the same applicant's as in the case of German Patent DE-OS 39 11 804, it is not surprising that despite the distinction of impulses there still takes place a separation of sensors and weapon, which is ascribed to a prejudice to the effect that such a separation always appears necessary. Furthermore, the arrangement of several sensors according to German Patent DE-OS 40 22 038 is disadvantageous in as much as the susceptibility to errors in the registration and summarizing of measured impulses and their identification is very great.

SUMMARY OF THE INVENTION

The aim of this invention is to improve a known device and a known process for the monitoring of the number of movements of at least one movable part 3 of a firearm in such a way that the aforementioned disadvantages are at least partly overcome.

This aim is achieved according to this invention by providing means for the detection of at least one parameter of the movement, in which system the means have a sensor 4 as well as processing arrangements which deliver a characteristic distinguishable impulse for each movement of the movable part 3. For the achievement of the same goal, the process according to this invention is carried out in such a manner that the duration of the movement of the movable part 3 of the firearm is measured with the aid of a sensor 4, preferably evaluated over a circuit 6, and finally stored in a memory 8.

Similarly or identically appearing characteristics of the firearm often have an entirely different cause. When these characteristics—as in the present case—are further measured used for the processing of the firearm, then this invention is applicable. In the state of the art, to be sure, likewise a signal is recorded for each measured operation of the firearm. The causal effect generates a signal there, which is compared with a similar or identical effect, and, correspondingly always brings about a similar measurement. There, however, the signal must be further analyzed in order correctly to characterize the causal effect. This is possible with the aid of this invention.

The impulses according to this invention present the characteristic features of the firearms. Such characteristics would correspond to, for example, the intensity or amplitude, but also the shape and duration of the impulse. With the aid of the shape of the impulse as a measure of the movement of a moved part, this part can be clearly identified. In a further preferred embodiment of this invention, the means for the detection are arranged in such a way that they record the duration of the impulse characteristic for the particular movement of a movable part. As already mentioned, different operations of the firearm also impose different loads on the movable parts. This is due, however, not only to the force stress of the movable parts, but also to the duration of this force stress. Thus, for example, a loading operation takes longer than a shooting operation, and the firing operation—as is explained later on—likewise can differ substantially from one another. A measure of the difference of the movement of the movable part is the duration of its stressing. This in turn can be detected by determining an impulse shape and its length in time.

In another embodiment of this invention, the sensor 4 has a movement recorder, which operates electromagnetically and/or optically and/or acoustically and/or mechanically. The movement recorder records the time sequence of or the time spacing of the parts movements, which correspond to a particular operation of a firearm. In particular, the types of operation such as single firing, continuous firing or, if need be, burst firing can be readily distinguished by taking the simple derivation with respect to time of the signal output from the measuring sensor 4. External mechanical shocks to the firearm do not effect the operation of the recorder as long as they do not cause a movement of that component activating the measuring sensor 4. In construction, it is theoretically possible to arrange the movement recorder to a position in which it outputs a signal each time that the breech-block of the firearm reaches its open position. This event, obviously, occurs in continuous firing or in burst firing in a considerably shorter time sequence than in the case of loading by hand or also in the case of single firing. Furthermore, slight movements of the component, such as that made by a submachine gun breech-block when the submachine gun falls onto the ground, may be disregarded.

It is particularly desired to arrange the movement sensor 4 opposite the weapon to record the movement path of at least one of its movable part and to generate a signal when the movable part—as for example, in the case of a reloading process or of the firing of the firearm—moves from its rest position. In the case of locked firearms or in firearms whose breech-block executes a rotary movement, the effect of an external shock on the movement of such a component is, as a rule, negligible. For this reason it is desired in accordance with this embodiment, to mount a measuring sensor 4 in such a way that it outputs a signal when the component moves from its rest position, which it occupies in the ready-to-fire state of the firearm. Thus, a manual loading operation is also distinguishable from a shooting operation, since it takes a longer time. The time spacing between two signals output from the measuring sensor in manual loading is, namely, greater than the spacing in firing. Here, it is desired to connect a flip-flop circuit 6 to the output of the measuring sensor 4. Thus, a signal is generated as long as the breech-block is open and/or when the component has left its rest position.

In particular, this invention is particularly adapted for use with firearms whose barrel, breech-block and reloading arrangement are spring supported in a casing. In manual loading, the system remains in its end position, but the component to be monitored executes a loading movement. In shooting, the system leaves its end position and springs back in order to soften the recoil, but returns after each shot in single firing and continuous firing to its end position. The time spacing between the signals in both of these cases, however, is different and distinguishable. In burst firing, the firearm executes a lengthened recoil, which acts on the rifleman to bring the firearm out of direction, only after delivery of the third shot when the burst firing has stopped. In this case, the component returns to its rest position only after a longer period as compared with the case of the single shot in single or continuous firing, but after a shorter period of time than in the case of manual loading. Preferably, the delivery of a signal to the movement recorder begins when the part moves from its rest position and ends when it returns to its rest position.

It is desired to fit the means for detecting at least one parameter of part movement into a compact casing. If needed, an extended life current supply such as a lithium battery may be also fit into the casing. It is also desired to dispose a measuring sensor in this casing, so that it forms altogether a single module. The module is mounted on or, preferably, in the firearm in a place where the measuring sensor can measure the part movement, but not disturb the functioning of the firearm. Since the size of the module mentioned depends primarily on that of the batteries, the measuring sensor operates to convert the sensed part movements into corresponding values of an electric current, which is then supplied to a circuit to be described in the following. In order to make this possible, the sensor 4 according to this invention comprises an acceleration measuring sensor. In a preferred embodiment of this invention, the acceleration measuring sensor 4 operates according to the laws of magnetic induction and, in particular, comprises a coil and also a permanent-magnetic mass, which are movable relative to one another. This embodiment can if required be modified so that a movable steel component of the breech-block system of the firearm is magnetized to form the permanent magnet and the measuring sensor is constructed as an adjacent, fixed coil. A current is induced in the fixed coil, when the magnetized component and the coil are moved relatively to one another.

According to a further embodiment of this invention, the sensor is an optically responsive sensor 4, which senses the movement of a firearm part, which supports an optical mechanism such as an optical reflector, an optical absorption medium or the like. The use of a beam of visible or ultraviolet light is preferred to infrared radiation, since the latter could be disturbed by heat radiation arising from the hot firing of the firearm. An optically active sensor 4, which could be mounted in the interior of the firearm and is not exposed to the environmental light, has the special advantage over magnetically acting sensors because it is not disturbed by external magnetic fields, which are present in the vicinity of transformer stations. The possible magnetization of steel firearm parts in such fields would not influence the measured values provided by optical sensors. It is known that optical measuring instruments have good response characteristic and in a closed system are only rarely subject to disturbances of a general nature.

In a preferred embodiment of this invention, there is included a circuit which processes signals derived from the sensor to produce pulse-like signals of a duration corresponding to the movement of the respective part of the firearm. As a separate component of the monitoring system, this circuit is interchangeable as a module. Further, it is possible, independently of the sensor 4, to use a circuit 6, which is adapted for a particular firearm.

In a preferred embodiment of this invention, there is included a memory 8 for storing the pulse-like signals from the sensor 4, which are indicative of at least one parameter of the movement of the firearm part and/or for storing additional, weapon-indicating information, such as, for example, the weapon number, the date of manufacture, the date of reconditioning and/or the coding of changed parts. These signals are stored in the memory 8 as information data either in a distinguishable form or, before the storing, are subdivided into different memory locations and then summed in its distinct location. The memory 8 may also be arranged in such a way that it stores the different signal forms unaltered. In this case, the distinguishing of the different information data is not carried out until the evaluation, preferably in a control apparatus, which will be explained. In any case, the number of manual loading operations, the number of shots delivered in single firing, and the number of shots delivered in continuous firing and firing bursts may be accessed from this memory.

The memory 8 can, however, also store additional firearm-specific information data. In addition to the weapon number or a similar identification coding of the particular firearm, information data identifying the dates of manufacture, of putting into service, of reconditioning or, for example, which parts have been reconditioned. Especially in the case of weapons used in police or guard duty, each special entry into service can be stored. By the teachings of this invention, the use of a particular weapon in particular circumstances may be recorded and latter accessed without a doubt. At rifle ranges, the number of shots delivered can be compared directly with the number of cartridges issued. The embezzlement of single live cartridges by faking the shot delivery is not possible. In the testing of firearms, data can be stored which will provide a basis for conclusions about the loads imposed on the firearms, e.g., the degree of fouling before use or inspection of the firearm. The previously required making of protocols and their administration now becomes unnecessary. Thus, data definitive of each weapon remain permanently attached to that weapon. Confusion, therefore, is precluded.

Further, it is also possible to record the use of a maneuver cartridge which stores powder gas. Maneuver cartridges are not fired along with live ammunition, but only with maneuver ammunition, which under some circumstances can lead to weapon wear which is characteristic of such cartridges.

In another embodiment of this invention, the memory 8 is adapted for contact-free transfer of values stored therein (pulse-like signals, information data) to a control apparatus separate from the firearm. Such a memory 8 is particularly adapted for use in a place of the firearm, which is not shielded by a metal wall from the receiver of the control apparatus. Preferably this memory 8 is integrated into the casing of the monitoring apparatus of this invention, which is housed inside of a nonmetallic part of the firearm, e.g., the inside of a plastic casing wall or of a pistol stock. Thus, the inspection of the firearm is made simpler. Errors that are due to fouled contacts are avoided. Such contact-free transfer may be implemented by an induction coil within the monitoring apparatus, which is inductively coupled to an induction coil of the control apparatus.

In a preferred embodiment of this invention, the control apparatus is adapted to store values in the memory or to change the present values in the storer. Thus, the possibility that values stored or to be stored in the firearm can be manipulated by unauthorized third parties is avoided.

The sensors 4 can be constructed to reduce their current consumption. In a further embodiment of this invention adapted to further lower current consumption and thus to lengthen the battery life or to reduce the battery capacity, there is provided an arrangement for the automatic switching on and off of the circuit or of the current supply before or at the start and after the end of the use of the firearm. The firearm is always moved before it is used. An acceleration sensitive device is adapted to respond to each handling of the weapon to generate a small current, which enables and retains a switching circuit 6 in its on state. If the weapon is not moved for a certain period of time, e.g., the weapon is placed in storage before issuing, in the weapons room of a unit or in the rifle stand of a guard house, then the switching circuit automatically returns to its off state.

It is also possible to monitor the capacity of or the electric charge built up on the firearm. The corresponding values change significantly when the weapon is taken in hand. The magnetic field change in the environment of the weapon can be sensed as the parameter for turning on the switching circuit.

DESCRIPTION OF THE DRAWINGS

The invention is explained still in detail with the aid of the appended schematic drawings by way of example. In these:

FIG. 2*a* another schematic partial view of the system, in which the loading for a single shot is represented;

FIG. 2*b* the signal occurring in the switching circuit while loading for a single shot;

FIG. 3*a* the schematic partial view of the system already shown in FIG. 2*a*, in which the loading for continuous firing is represented;

FIG. 3*b* the signal occurring in the switching circuit in the case of loading for continuous firing;

The reference numbers always designate the same parts in all of the figures.

DESCRIPTION OF THE PREFERRED EMBODIMENT

The system represented in the figures is spring supported in a casing (not shown) and presents a roller 1 borne transversely to the axis of the bore, which is crossed by a radial bearing bore aligned with the axis of the bore. A latch 2 holds the roller 1 fast in its particular rotary position.

Figures 4A, 4B:
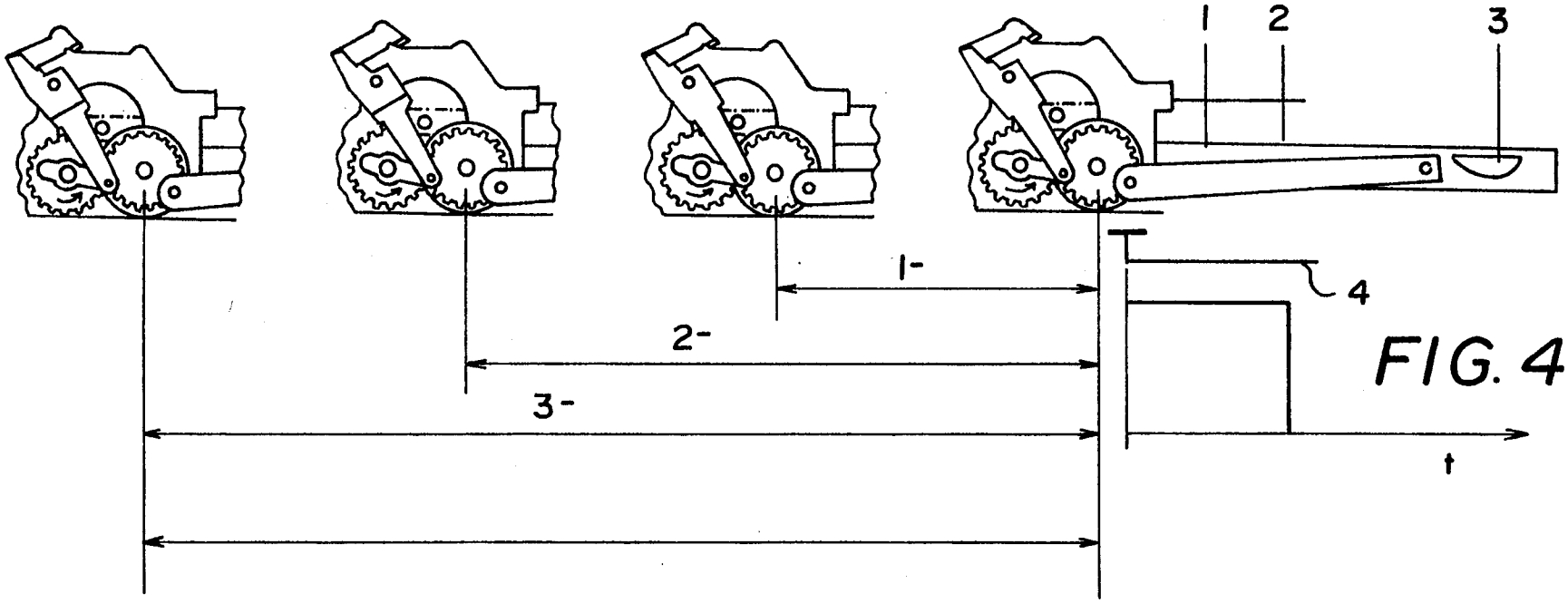
FIG. 4*a* the schematic partial view of the system already shown in FIG. 2*a*, in which there is represented the loading for the case of the triple shot (a firing burst with three shots) and FIG. 4*b* the signal occurring in the switching circuit while loading in the case of the triple shot.

The roller 1 is coupled to a connecting rod 3 (cd. FIGS. 2*a*, 3*a* and 4*a*), whose rear end, as shown in FIGS. 1*a* to 1*d*, is articulated eccentrically on a gear wheel. As the gear wheel is so driven through a full revolution in the direction of the arrow, the roller 1 rotates forwardly once and back once through an arc of 90°. The connecting rod 3 executes in this process a translation and tilting movement.

Figure 1A:
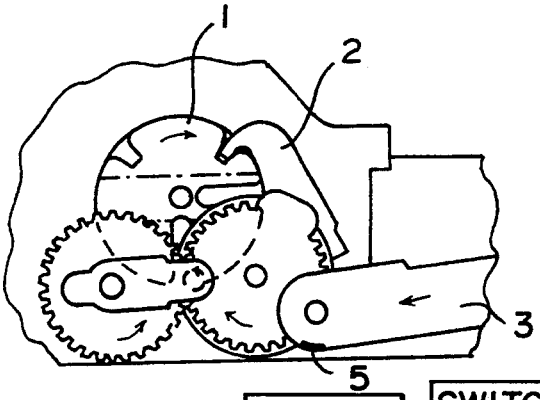
FIG. 1*a*–1*b* shows a schematic partial view of the system of a firearm, in which the loading by hand is represented, wherein it is understood that the structure per se of the firearm is well known in the art, FIG. 1*e* the signal arising in the switching circuit while loading by hand.

FIG. 1*a* shows the rest position, which this system occupies up to the manual loading operation or up to the triggering of a shot. The latch 2 locks in position the roller 1, so that the roller's bearing bore aligns with the axis of the bore.

Figure 1B:
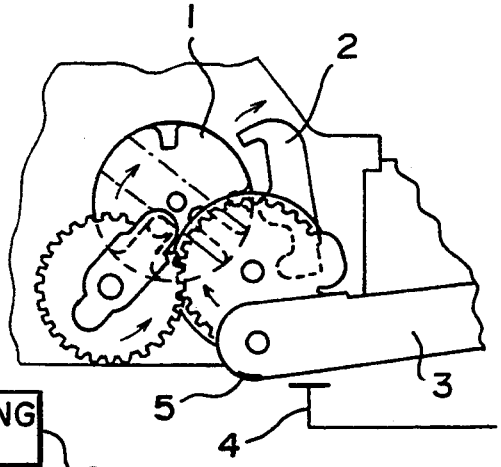

FIG. 1*b* shows the position of the system which it occupies after the start of the manual loading operation. The latch 2 is free of the roller 1, which has turned through 45° and the rear end of the connecting rod 3 is displaced to the rear.

Figure 1C:
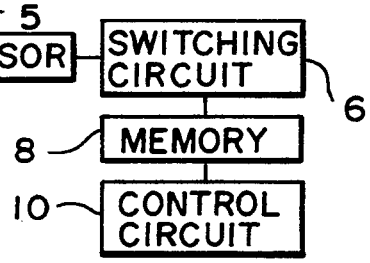
Figure 1C:
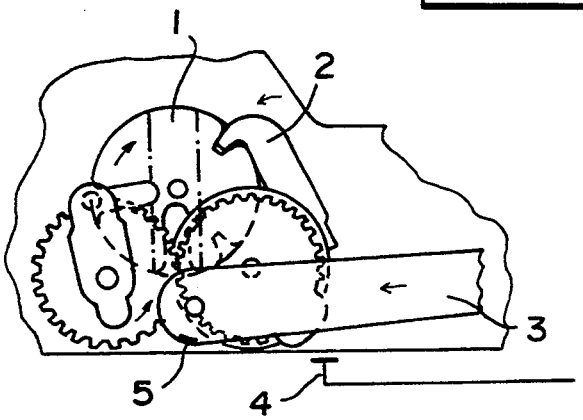

FIG. 1*c* shows the loading position. The bearing of the roller 1 faces upward and is ready for the reception of a downwardly disposed, shell-less cartridge. The latch 2 holds the roller 1 fast in this position, and the rear end of the connecting rod 3 is shifted still further to the rear. If an unfired cartridge remains in the bearing bore, it can drop out or be ejected by the insertion of the next cartridge.

Figure 1D:
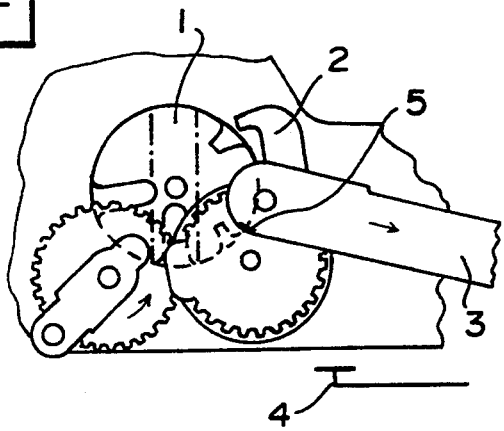
Figure 1E:
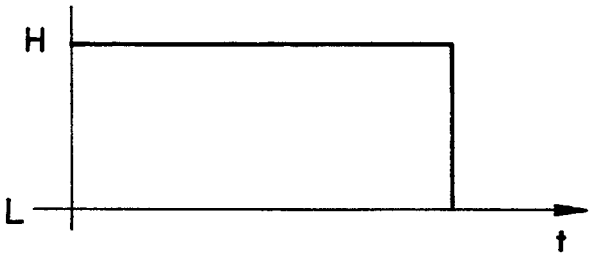

During the loading operation, the gear wheel continues to turn and controls the loading process until it has reached the position shown in FIG. 1*d*. In this position, the roller 1 is again unlocked and begins to return to the position of FIG. 1*a*. During this movement, the gear wheel executes about a half revolution and can, for example, cock the rejecting mechanism. After this half revolution, the connecting rod 3 returns to the position shown in FIG. 1*a*.

During this entire process, the total system consisting of barrel, lock and reloading mechanism does not move from its front end position. This does occur, however, during the shot when recoil acts on the system, as will be discussed with respect to FIGS. 2*a*, 3*a* and 4*a*. During a single shot (FIG. 2*a*), the system executes a recoil for a first interval and then returns to its front end position. This process, however, is significantly shorter than the reloading process shown in FIGS. 1*a* and 1*d*.

In continuous firing (FIG. 3*a*), each successive shot is released only when or after the system has again reached its front end position. In the case of the single shot or of the continuous firing, accordingly, the rear end of connecting rod 3, after an always equal defined time corresponding to the return motion, occupies the position shown in FIG. 1*a*. This process is repeated, however, in the case of continuous firing (FIG. 3*a*) at short, fixed intervals of time.

The process is otherwise in the case of the triple shot, which is represented in FIG. 4*a*. In each instance, the following shot is not only ignited when the system has returned to its front end position, but also after conclusion of the reloading operation, when the system parts have returned to the position shown in FIG. 1*a*, but the entire system is still in the return motion or has just begun it. Thus, the return motion to the rear is twice (in the case of three shots) lengthened, so that the system returns to its front end position only after a clearly longer period of time than is the case with the single shot (FIG. 2*a*) or in the case of continuous firing (FIG. 3*a*).

The rifle of the shown embodiment contains a monitoring apparatus integrated into a casing, with a measuring sensor 4 which comprises an optical transmitter for transmitting a beam of light as well as an optical receiver for the reception of the reflected light radiation.

There is provided on the underside of the rear end of the connecting rod 3 a marking 5 or a surface texture which causes the beam of light emitted from the optical transmitter to be reflected to the optical receiver or sensor 4 when and only when the connecting rod is disposed in its front end position. This requirement is fulfilled by the condition that only when the connecting rod 3 is disposed in the position of FIG. 1*a*, it is disposed both opposite the measuring sensor 4 and also in the angular position required for the reflecting the beam of light onto the measuring sensor 4. Each time that the light beam is reflected onto the measuring sensor 4, the switching circuit 6 begins or ends the output of a signal. There is provided, therefore, for each type of rifle operation a signal having a configuration characteristic thereof, which is shown in FIGS. 1*e*, 2*b*, 3*b* and 4*b*. In the case of manual loading (FIG. 1*e*), the signal duration is clearly longer than in the case of the triple shot (FIG. 4*b*). The signal duration of the triple shot in turn is clearly longer than in the case of the single firing (FIG. 2*b*) or continuous firing (FIG. 3*b*). In the case of the continuous firing, the individual signals follow according to a characteristic, particularly short interval of time. This characteristic, pulse sequence is achievable neither with repeated manual loading nor in repeated delivery of single or triple shots.

Each of the signals shown or the corresponding signal sequence is therefore distinctly characteristic of a corresponding manual loading, single firing, triple shot or continuous firing, and is stored as corresponding data in the memory 8 of the monitoring apparatus. A control device 10, as illustrated in FIG. 1*a*, performs such an analysis by reading from the memory 8 the characteristic data, which is used to determine the number of respective events and/or to diagnosis the condition of the rifle, the requirement of parts to be changed, etc.

The criterion is in every case the duration or the cadence of the signals, not their intensity or amplitude. Accordingly, a change or fluctuation in the amplitude of the sensor signals through fouling or oiling of the weapon interior, a weakening battery and the like, is without influence on the measurement accuracy.

If the rifle should fall on its butt or its butt strike the ground, for example, while jumping from a motor vehicle, the system should rebound a little. Such impact is of very brief duration. Thus, the corresponding length extension of the reflecting zone on the underside of the connecting rod 3 can be suppressed and does not affect the measuring process.

We claim:

1. A method of monitoring the movements of at least one part of a firearm, said method comprising the steps of:

a) sensing the part movement to provide a corresponding signal; and b) processing said corresponding signal to provide a distinguishable pulse, characteristic of the firing operation effected by the movement of the part.

2. The method of claim 1, wherein the width of said pulse corresponds to said part movement.

3. The method of claim 1, wherein there is further included the step of storing said pulse.

4. The method of claim 1, wherein the generation of said pulse is initiated when the part commences to move.

5. The method of claim 4, wherein said pulse is cut off when the part comes to a rest, whereby the width of said pulse corresponds to the time period during which the part is moved.

6. The method of claim 1, wherein said method further includes the step of sensing the beginning and ending of the movement of the firearm part.

7. The method of claim 1, wherein the step of sensing includes the directing of optical radiation onto the moving part.

8. The method of claim 7, wherein the optical radiation lies in the visible spectrum.

9. A method of monitoring the movements of a breech-block of a firearm, said method comprising the steps of:

a) sensing the time duration of a sequence of cyclical movements of the breech-block to provide a like sequence of pulses, each cyclical movement of the breech-block from and to a rest position provides each pulse of a width initiated upon the movement of the breech-block from the rest position and terminated upon the return movement of the breech-block to the rest position, each cyclical movement corresponding to a bullet firing, and b) analyzing the number of, duration of and time spacing between successive ones of the pulses to determine the nature of the firearm operation effected by at least one movement of the breech-block.

10. A method of monitoring the movements of at least one part of a firearm, said method comprising the steps of:

a) sensing the time duration of a sequence of cyclical part movements to provide a number of pulses, each of a corresponding width; and b) analyzing the number of the pulses to determine the nature of firearm operation.

11. The monitoring method of claim 10, wherein step a) of sensing senses the cyclical movement of the part from and to a rest position to provide the pulse of a width initiated upon the part movement from the rest position and terminated upon the return of the part movement to the rest position.

12. The monitoring method of claim 11, wherein the part comprises a breech-block.

13. The monitoring method of claim 10, wherein step b) of analyzing analyzes the width of each pulse.

14. The monitoring method of claim 13, wherein step b) of analyzing analyzes the time spacing between successive ones of the pulses.

* * * * *